US005911780A

United States Patent [19]

Hamasaka et al.

[11] Patent Number: 5,911,780

[45] Date of Patent: Jun. 15, 1999

[54] GEAR SHOT PEENING METHOD

[75] Inventors: Naoji Hamasaka; Chikara Nakao, both of Osaka; Takashi Kuse, Ishikawa, all of Japan

[73] Assignee: Komatsu Ltd., Tokyo, Japan

[21] Appl. No.: 08/875,103

[22] PCT Filed: Jul. 10, 1996

[86] PCT No.: PCT/JP96/01951

§ 371 Date: Jul. 21, 1997

§ 102(e) Date: Jul. 21, 1997

[87] PCT Pub. No.: WO97/02925

PCT Pub. Date: Jan. 30, 1997

[30] Foreign Application Priority Data

Jul. 13, 1995 [JP] Japan ..... 7-177779

[51] Int. Cl.[6] ..... B23F 19/00; C21D 7/06

[52] U.S. Cl. ..... 72/53; 29/90.7

[58] Field of Search ..... 72/53; 29/90.7

[56] References Cited

FOREIGN PATENT DOCUMENTS

| | | | |
|---|---|---|---|
| 62-7245 | 2/1987 | Japan | 72/53 |
| 4-107209 | 4/1992 | Japan | 72/53 |
| 05033047 | 2/1993 | Japan . | |
| 5-33047 | 2/1993 | Japan | 72/53 |
| 6-172850 | 6/1994 | Japan | 72/53 |
| 6-172851 | 6/1994 | Japan | 72/53 |
| 6-172852 | 6/1994 | Japan | 72/53 |
| 06254765 | 9/1994 | Japan . | |

OTHER PUBLICATIONS

The Iron Age, "Shot Blasting Gears to Improve Fatigue Life", p. 63, Mar, 1944.

*Primary Examiner*—David Jones
*Attorney, Agent, or Firm*—Armstrong, Westerman, Hattori, McLeland & Naughton

[57] ABSTRACT

A shot peening method for gears capable of hardening a gear without formation of projections on the tops of its teeth and gears having no projections and treated by this shot peening method are provided. After a preliminary shot has been performed to harden the top of a tooth of the gear by shooting only at the top of the tooth using an air nozzle, a bottom land shot is performed by shooting shots at a bottom land in a substantially perpendicular direction thereto with an air nozzle, whereby the gear is entirely hardened.

3 Claims, 7 Drawing Sheets

GEAR SHOT PEENING METHOD

TECHNICAL FIELD

The present invention relates to a shot peening method for blasting the external surface of a gear with small shots while rotating the gear to harden the external surface and relates to gears treated by such shot peening.

BACKGROUND ART

In recent years, there have been growing demands for the miniaturization of, for example, automobile engines, which has given rise to a need for small-sized gears. Simple size reduction makes gears incapable of withstanding loads such as rotating torque, and therefore many attempts have been made to improve the strength of gears. As one of the measures for improving the strength of gears, shot peening is widely known. Shot peening is a treatment for hardening the surfaces of objects such as gears by blasting their peripheral surfaces with shots such as steel balls by use of an impeller or nozzle.

FIG. 7 illustrates one example of shot peening utilizing a nozzle. In FIG. 7, shots 101 such as steel balls collide with the external surface of a gear 100. The gear 100 is so configured as to comprise (i) top lands 102, (ii) bottom lands 103, (iii) tooth flanks 104 each of which is formed, for example, by an involute curve extending from each bottom land 103 to each top land 102 and (iv) chamfers of tooth top 105 each positioned between each tooth flank 104 and each top land 102. The shots 101 are shot from a nozzle 106. The shooting direction 107 of the shots 101 from the nozzle 106 is substantially perpendicular to one of the bottom lands 103 of the gear 100 being rotated.

Such a conventional shot peening method, however, suffers from the problem that plastic deformation occurs in the tops of the teeth of the gear 100 and particularly on the ridge lines each of which is the intersection of each tooth flank 104 and each chamfer of tooth top 105, on account of the shock caused at the time of collisions of the shots 101, and this deformation leads to formation of small projections 108 on the tooth flanks 104. The projections 108 harm another gear which is in mesh with the gear 100, with the result that the service life of the gear is shortened. In addition, when the gears come into mesh with each other, they make a noisy action owing to the presence of the projections 108.

The present invention has been made for the purpose of overcoming the foregoing problems and therefore one of the objects of the invention is to provide a shot peening method for gears capable of hardening the surface of a gear without formation of projections on its tooth tops. Another object of the invention is to provide gears of high strength hardened by this shot peening method.

DISCLOSURE OF THE INVENTION

With the above objects in view, the invention provides a shot peening method for gears for blasting the external surface of a gear with shots while rotating the gear to harden the external surface, the gear comprising top lands, bottom lands, tooth flanks each curving from each bottom land to each top land, and chamfers of tooth top each positioned between each tooth flank and each top land, the method comprising:

(1) a preliminary shot step for shooting the shots such that the shots collide with the top of a tooth of the gear exclusively; and (2) a bottom land shot step for shooting the shots at one of the bottom lands in a substantially perpendicular direction thereto after the preliminary shot step such that the shots collide with the entire gear.

In the shot peening method for gears according to the invention, prior to "the bottom land shot" for shooting shots substantially perpendicularly to one of the bottom lands of the gear, the preliminary shot is performed so as to make the shots collide with the top of a tooth of the gear to harden the tooth top beforehand. With this arrangement, when the shots collide with the tooth top during the bottom land shot step, no projections will be formed on the tooth top, so that a higher degree of hardening can be ensured. In this way, the shot peening method of the invention solves the problems of shortening the service life of the other of a pair of meshing gears and of a noise made when the gears come into mesh with each other.

The shot peening method of the invention is preferably arranged such that, in a plane that crosses the axis of the gear at right angles, the target of shooting in the preliminary shot step is a ridge point that is the intersection of the chamfer line of tooth top and the tooth flank line, these lines being positioned in the upstream part of the tooth when viewing the tooth in the rotating direction of the gear, and such that the axis of a nozzle for the preliminary shot is positioned in an area between a bisector which bisects the interior angle of a corner having the ridge point as its intersection and a straight line which connects the ridge point and the apex of another tooth opposite to the ridge point.

By arranging the shooting direction of the preliminary shot step as described above, the neighbor part of the ridge point that is the intersection of the chamfer line and the tooth flank line, where projections are most likely to be formed, is hardened and squeezed into a round shape or an obtuse angled shape. As a result, the formation of projections on the tooth face can be effectively restricted. In this case, if the axis of the shooting direction for the shots is positioned beyond the bisector of the interior angle of the corner having the ridge point as its intersection, the striking force of the shots will be concentrated on the side of the tooth flank relative to the ridge line formed by the chamfer of tooth top and the tooth flank, increasing the likelihood of formation of a projection. If the axis of the shooting direction is positioned beyond the straight line which connects the ridge point and the apex of another tooth which is opposite to the ridge point, this opposite tooth interferes with the shot targeting at the ridge point.

Alternatively, the shot peening method of the invention may be arranged such that, in a plane that crosses the axis of the gear at right angles, the target of shooting in the preliminary shot step is a ridge point that is the intersection of the chamfer line of tooth top and the tooth flank line, these lines being positioned in the downstream part of the tooth when viewing the tooth in the rotating direction of the gear, and such that the axis of a nozzle for the preliminary shot is positioned in an area between a prolongation of the top land line and a prolongation of the chamfer line of tooth top of the downstream part.

In the method with the shooting direction of the preliminary shot step arranged as described above, if the axis of the shooting direction is positioned beyond the prolongation of the chamfer line positioned in the downstream part of the tooth relative to the rotating direction of the gear, the shots will laterally collide with the ridge point at which the chamfer line intersects the tooth flank line adjacent the chamfer line, these lines being positioned in the downstream part of the tooth relative to the rotating direction of the gear.

This is likely to cause formation of a projection on the tooth flank side relative to the ridge point. If the axis of the shooting direction is positioned beyond the prolongation of the top land line, the shot targeting at the ridge point, that is the intersection of the top land line and the chamfer line of the downstream part of the tooth, will be interfered with.

According to an embodiment of the invention, there is also provided a gear having an external surface which comprises top lands, bottom lands, tooth flanks each curving from each bottom land to each top land, and chamfers of tooth top each positioned between each tooth flank and each top land, the external surface of the gear being blasted with shots by shot peening which comprises:

(1) a preliminary shot step for shooting the shots such that the shots collide with the top of a tooth of the gear exclusively; and (2) a bottom land shot step for shooting the shots at one of the bottom lands in a substantially perpendicular direction thereto after the preliminary shot step such that the shots collide with the entire gear.

The gear according to the invention is treated by shot peening in which prior to "the bottom land shot" for shooting shots substantially perpendicularly to one of the bottom lands of the gear, the preliminary shot is performed so as to make the shots collide with the top of a tooth of the gear to harden the tooth top beforehand, so that there are no projections on the tooth tops of the gear.

Preferably, the gear of the invention is treated by shot peening arranged such that, in a plane that crosses the axis of the gear at right angles, the target of shooting in the preliminary shot step is a ridge point that is the intersection of the chamfer line of tooth top and the tooth flank line, these lines being positioned in the upstream part of the tooth when viewing the tooth in the rotating direction of the gear, and such that the axis of a nozzle for the preliminary shot is positioned in an area between a bisector which bisects the interior angle of a corner having the ridge point as its intersection and a straight line which connects the ridge point and the apex of another tooth opposite to the ridge point.

Alternatively, the gear of the invention may be treated by shot peening arranged such that, in a plane that crosses the axis of the gear at right angles, the target of shooting in the preliminary shot step is a ridge point that is the intersection of the chamfer line of tooth top and the tooth flank line, these lines being positioned in the downstream part of the tooth when viewing the tooth in the rotating direction of the gear, and such that the axis of a nozzle for the preliminary shot is positioned in an area between a prolongation of the top land line and a prolongation of the chamfer line of tooth top of the downstream part.

According to another embodiment of the invention, there is provided a gear having an external surface which comprises top lands, bottom lands, tooth flanks each curving from each bottom land to each top land, and chamfers of tooth top each positioned between each tooth flank and each top land, the external surface of the gear being blasted with shots by shot peening in which the arc height of a bottom land shot for shooting the shots substantially perpendicularly to one of the bottom lands is 0.6 mmA or more, and the projecting amount of a projection created on each ridge line of each tooth flank and each chamfer of tooth top being $5\mu$ or less.

According to the invention, the projecting amount of a projection created on each ridge line formed by each tooth flank and each chamfer of tooth top is set to $5\mu$ or less that is the allowable range required by considerations of the surface roughness of teeth. The arc height adopted in the invention is set to 0.6 mmA or more which enables "hard shot peening" to provide a high compressive residual stress, so that high strength can be achieved. Accordingly, the gear of the invention is satisfactory as a product both in terms of strength and precision.

Other objects of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF DRAWINGS

FIG. 1 is a partial side view illustrating a preliminary shot step according to the embodiment.

FIG. 2 is a partial side view illustrating another preliminary shot step according to the embodiment.

FIG. 3 is a partial side view illustrating a bottom land shot step according to the embodiment.

FIG. 4 is a schematic diagram illustrating an arrangement for performing the shot peening method for gears according to the embodiment.

FIGS. 5(*a*) and 5(*b*) are graphs demonstrating the results of tests conducted on shot peening according to the embodiment;

FIG. 6 is a perspective view of a gear hardened by shot peening according to the embodiment.

BEST MODE FOR CARRYING OUT THE INVENTION

Figure 1:
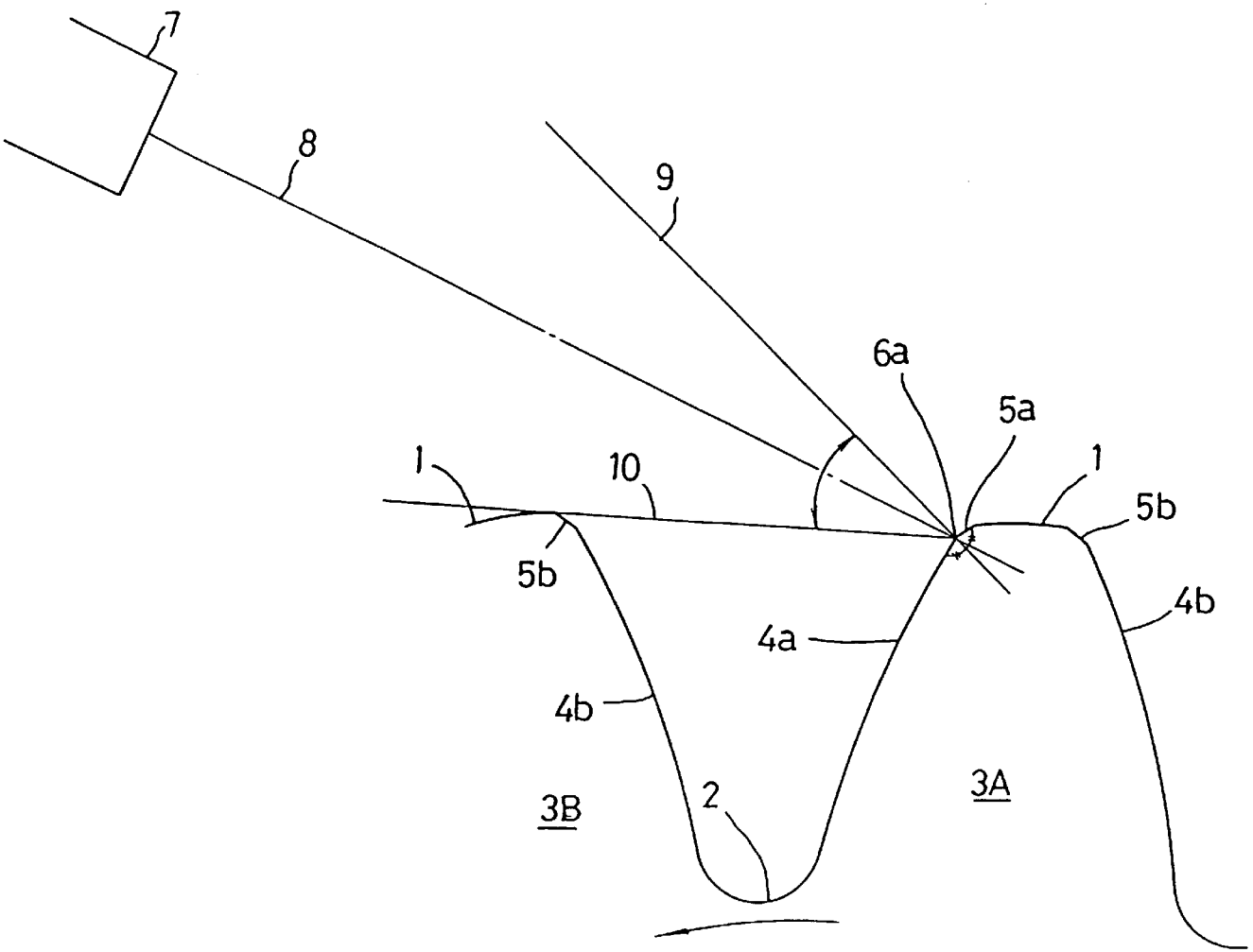
FIGS. 1 to 6 are associated with a shot peening method for gears according to one preferred embodiment of the invention.

Referring now to the drawings, a shot peening method for gears and associated gears will be described according to preferred embodiments of the invention.

FIG. 1 is a partial side view illustrating a preliminary shot step for gears according to one embodiment of the invention.

The external surface of a gear according to this embodiment has top lands 1, bottom lands 2, left involute faces 4*a*, right involute faces 4*b* and chamfers of tooth top 5*a*, 5*b*. In a tooth 3A, the left and right involute faces 4*a*, 4*b* respectively curve from the bottom land 2 to the top land 1, forming the side faces of the tooth 3A and the chamfers of tooth top 5*a*, 5*b* are formed between the respective left and right involute faces 4*a*, 4*b* and the top land 1. In the embodiment shown in FIG. 1, an air nozzle 7 is so arranged as to shoot shots (which are steel balls in this embodiment) at a ridge line which is formed by the left involute face 4*a* and the chamfer of tooth top 5*a* (for simplicity, this ridge line is hereinafter referred to as "ridge point 6*a*" which exists within a profile, i.e., a plane crossing the axis of the gear at right angles). More specifically, the air nozzle 7 is arranged such that the axis 8 of a shot of the steel balls from the air nozzle 7 passes through the ridge point 6*a*.

Figure 7:
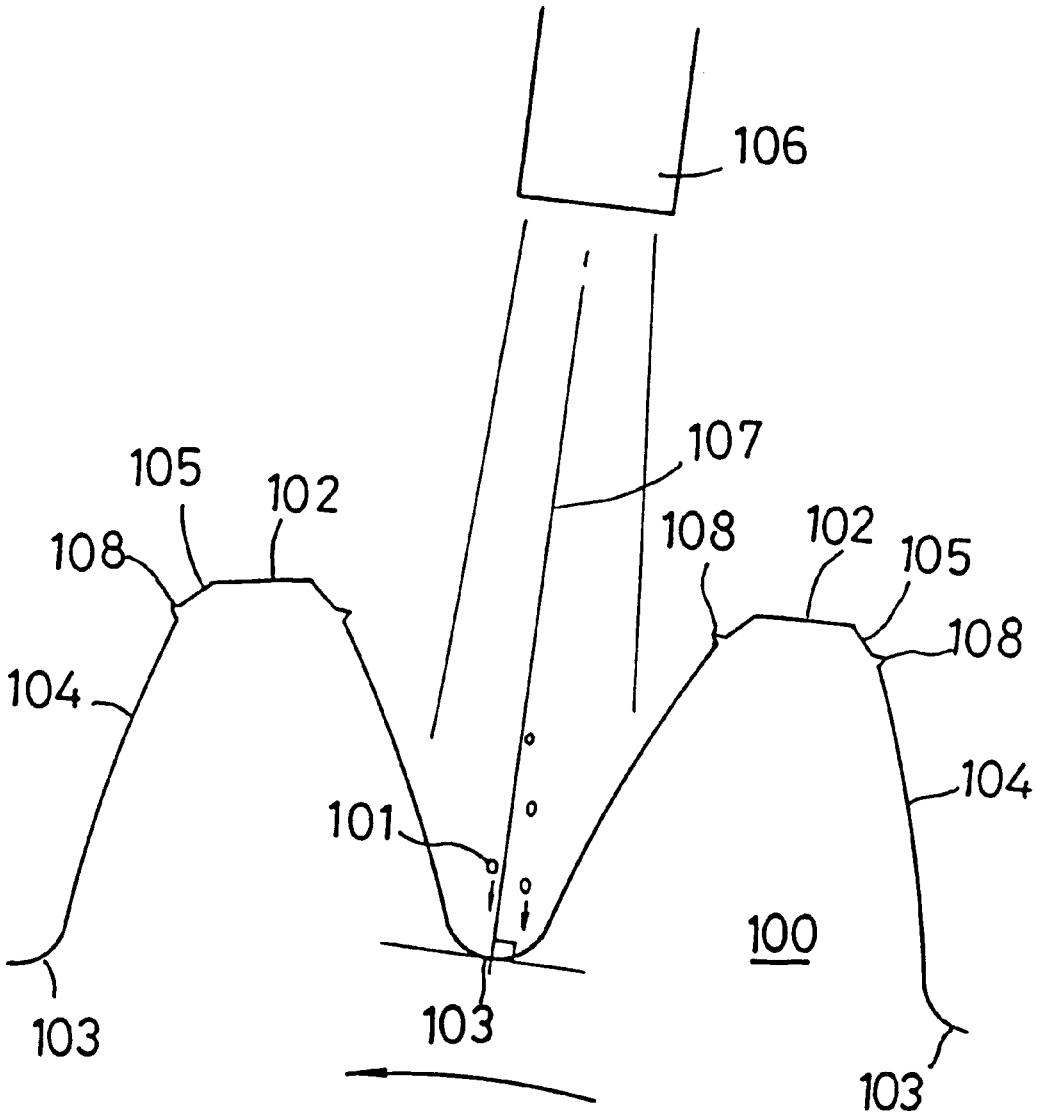
FIG. 7 is a diagram illustrating a problem presented by a prior art method.

The axis 8 of the air nozzle 7 is positioned within an area between a bisector 9 which bisects the interior angle of a corner having the ridge point 6*a* as its intersection and a straight line 10 which connects the ridge point 6*a* and the apex of a tooth 3B facing the ridge point 6*a*. The gear shown in FIG. 1 rotates counterclockwise, so that the ridge point 6*a*, the chamfer of tooth top 5*a* and the involute face 4*a* are moved and directed toward the air nozzle 7. It should be understood that FIG. 1 depicts one instantaneous state of the gear. In this way, the steel balls shot from the air nozzle 7 collide with the ridge point 6*a* and its neighborhood, namely, the top of the tooth 3A so that the top is hardened. The area on the involute face 4*a* side relative to the ridge point 6*a*, where the projection 108 is likely to form as illustrated in the prior art of FIG. 7, is squeezed into a round shape or obtuse angled shape. As a result, no projections form in the area on the involute face 4*a* side relative to the ridge point 6*a* during the bottom land shot to be described later.

If the axis 8 of the air nozzle 7 is arranged beyond the straight line 10 (i.e., positioned under the straight line 10 in FIG. 1), the tooth 3B will interfere with the shot targeting at the ridge point 6*a*. On the other hand, if the axis 8 of the air nozzle 7 is arranged beyond the bisector 9 (i.e., positioned above the bisector 9 in FIG. 1), the projection is likely to form in the area on the involute face 4*a* side relative to the ridge point 6*a*.

More preferably, after the gear has rotated counterclockwise as shown in FIG. 1, with the tooth top hardened, the gear is turned over to perform the same preliminary shot on the reverse side, so that the right and left sides of the tooth 3A can be symmetrically hardened and uniformly improved in strength.

Figure 2:
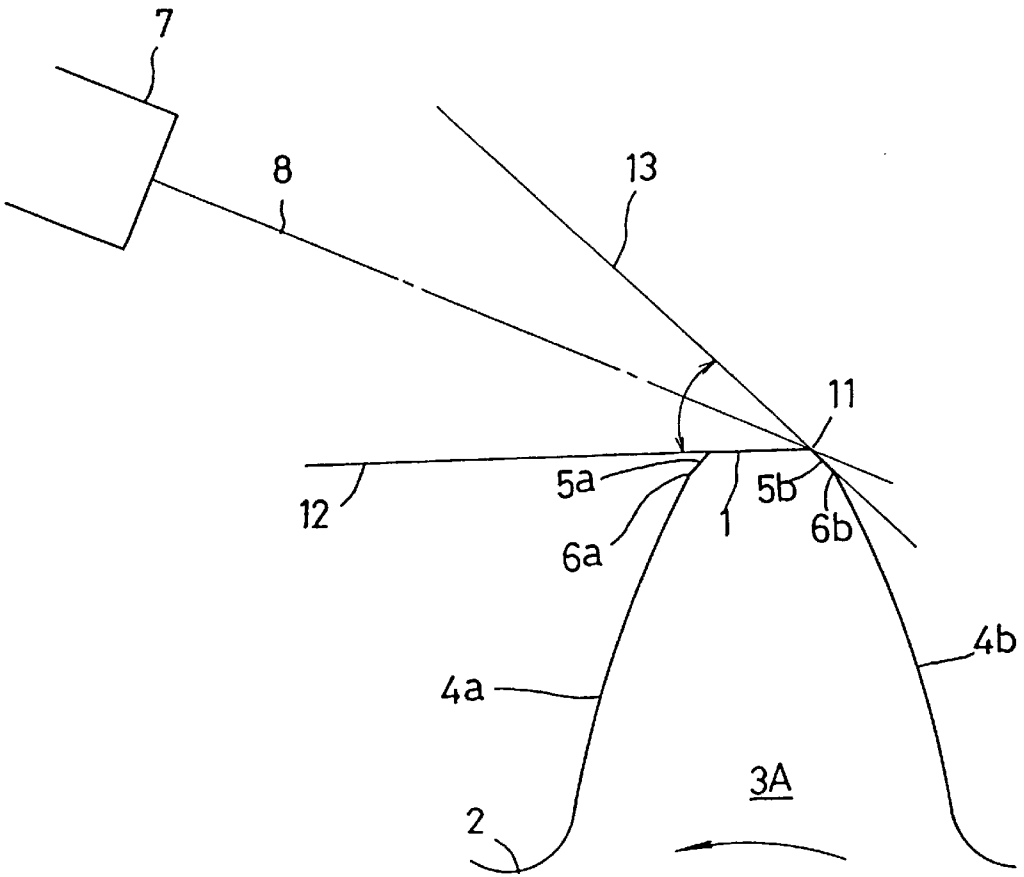
Figure 3:
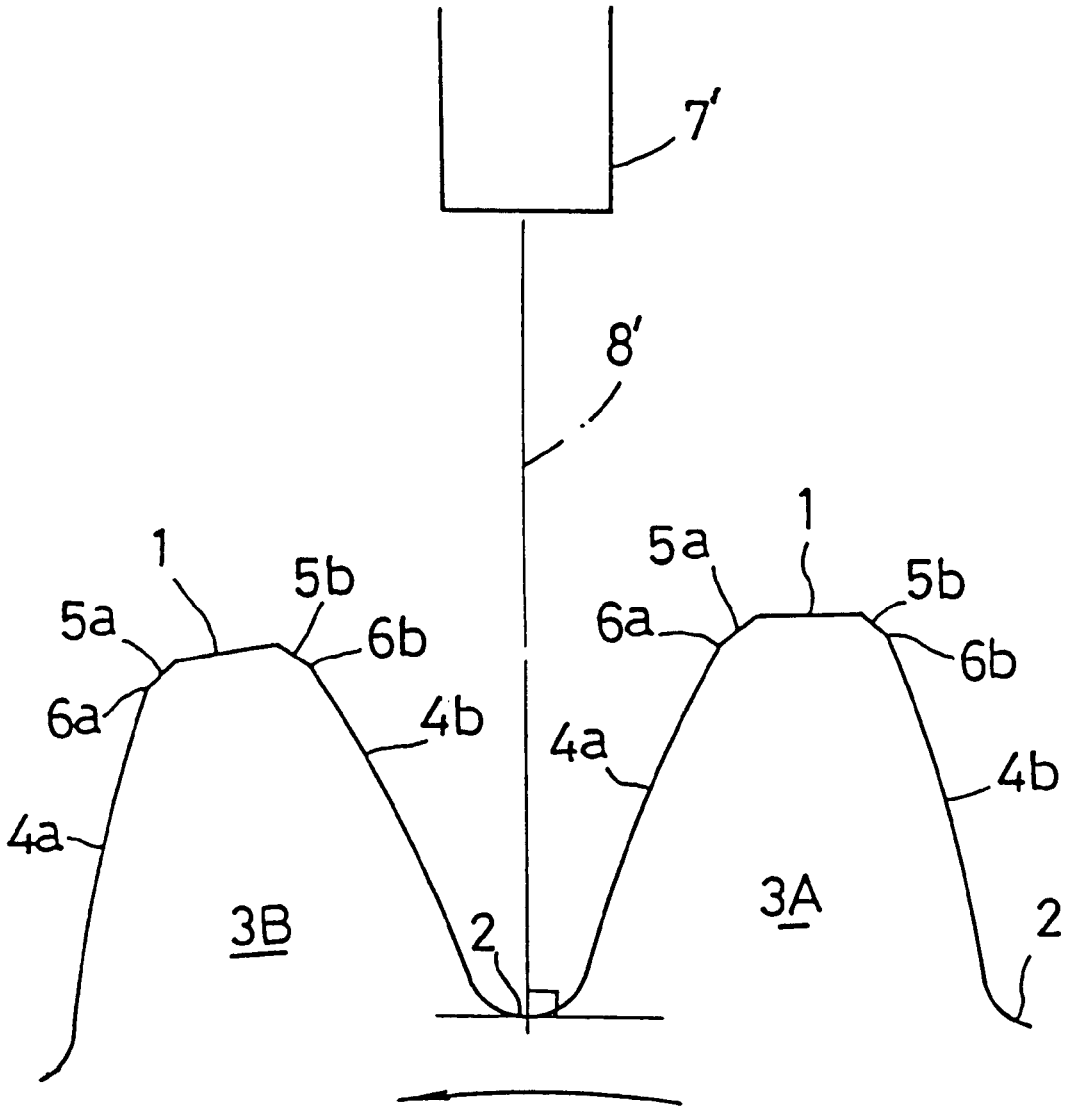

FIG. 2 shows another embodiment of the shooting direction of the air nozzle 7. The axis 8 of the air nozzle 7 passes through a ridge point 11 which is the intersection of the top land 1 and the right chamfer of tooth top 5*b* which is positioned downstream the left chamfer of tooth top 5*a* in the rotating direction of the gear. The axis 8 is arranged within the area between a prolongation 12 of the top land 1 and a prolongation 13 of the right chamfer 5*b*. It should be understood that FIG. 2 also depicts one instantaneous state of the gear and in reality, the steel balls collide with the entire part of the tooth 3A.

If the axis 8 of the air nozzle 7 is arranged beyond the prolongation 12 (i.e., positioned under the prolongation 12 in FIG. 2), the shot targeting at the ridge point 11 will be interfered with. On the other hand, if the axis 8 of the air nozzle 7 is arranged beyond the prolongation 13 (i.e., positioned above the prolongation 13 in FIG. 2), the projection is likely to form in the area on the right involute face 4*b* side relative to a ridge point 6*b* which is the intersection of the right chamfer of tooth top 5*b* and the right involute face 4*b*.

Similarly, in this embodiment, after the gear has rotated counterclockwise as shown in FIG. 2, with the tooth top hardened, the gear is preferably turned over to perform the same preliminary shot on the reverse side, so that the right and left sides of the tooth 3A can be symmetrically hardened and uniformly improved in strength.

After the preliminary shot has been performed as shown in FIG. 1 or 2 to harden the tooth top of the gear, an air nozzle 7' is such arranged that its axis 8' becomes perpendicular to the bottom land 2 to perform a "bottom land shot". The gear is rotating during the bottom land shot and therefore the steel balls collide with all of the parts, i.e., the bottom lands 2, involute faces 4*a*, 4*b*, chambers of tooth top 5*a*, 5*b* and top land 1 with the result that the gear can be entirely hardened. As the tooth top is hardened by the preliminary shot described earlier, no projections form on the tooth top during the bottom land shot.

Figure 4:
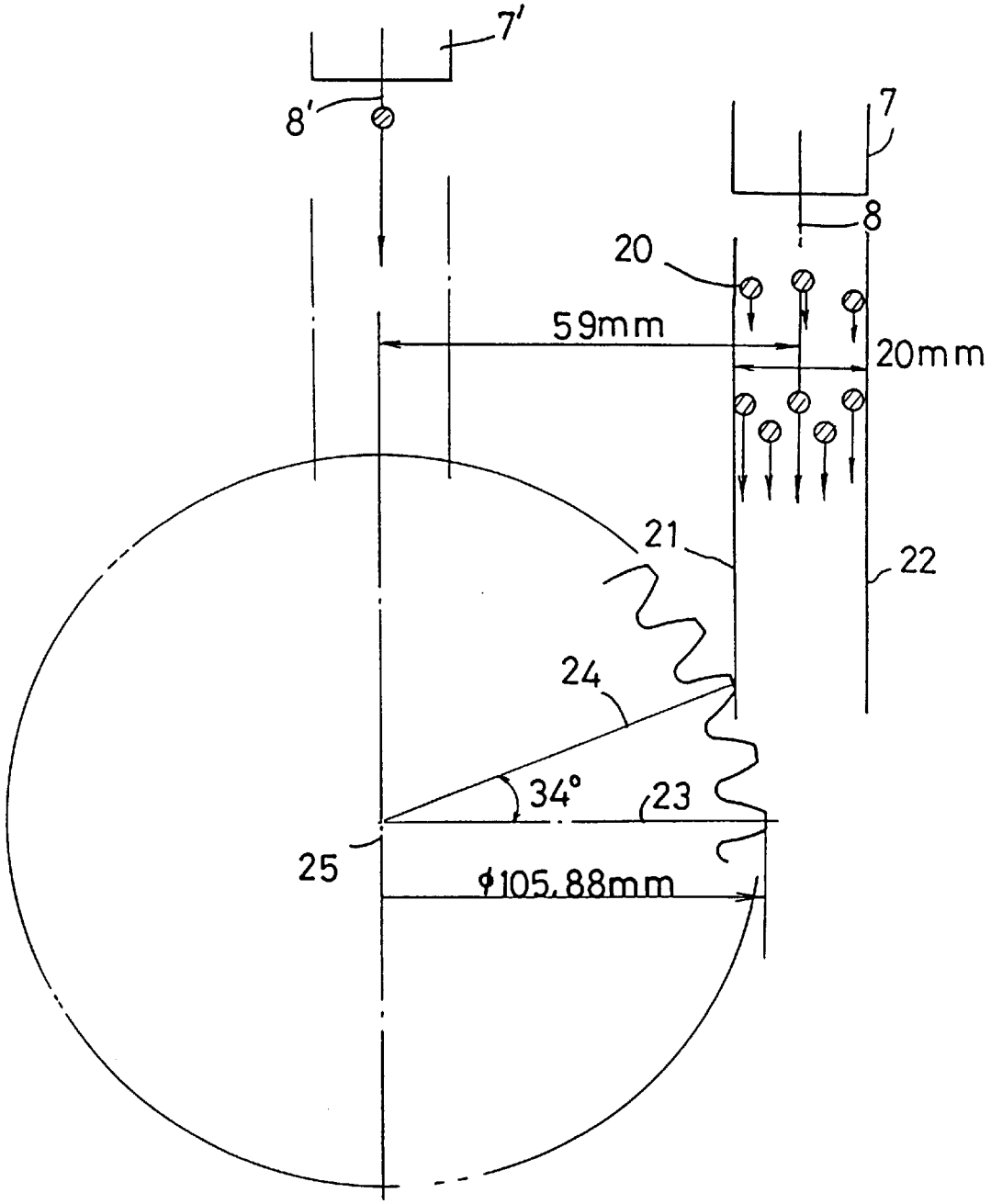

FIG. 4 shows the positional relationships between the gear and the air nozzles 7, 7'. For example, the diameter of the gear is 105.88 mm and the width of the shot of the steel balls 20 by the air nozzle 7 (the distance from the left end 21 of a shot area to the right end 22 thereof) is 20 mm. The position of the air nozzle 7 is arranged such that the left end 21 of the shot area contact the leading end of a radius sector 24 of the gear, the radius sector 24 being at 34° to a radius sector 23 of the gear that makes a right angle with the axis 8 of the air nozzle 7. In consequence, the distance between the axis 8 of the air nozzle 7 and the center 25 of the gear is 59 mm. The position of the air nozzle 7 in relation to the gear is arranged for performing the preliminary shot described in conjunction with FIG. 2.

In FIG. 4, the air nozzle 7' designed to perform the bottom land shot is the same as the above-described air nozzle 7 in size and disposed in parallel with the air nozzle 7. The axis 8' of the air nozzle 7' for the bottom land shot passes through the center 25 of the gear and the distance between the axis 8' of the air nozzle 7' and the axis 8 of the air nozzle 7 is 59 mm.

Figure 5:
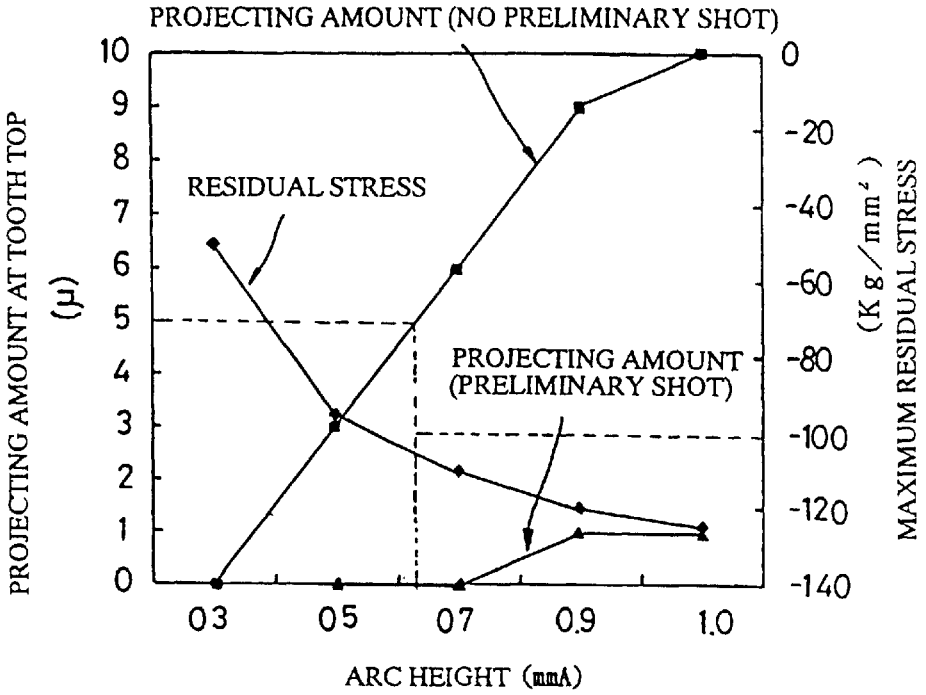
Figure 5:
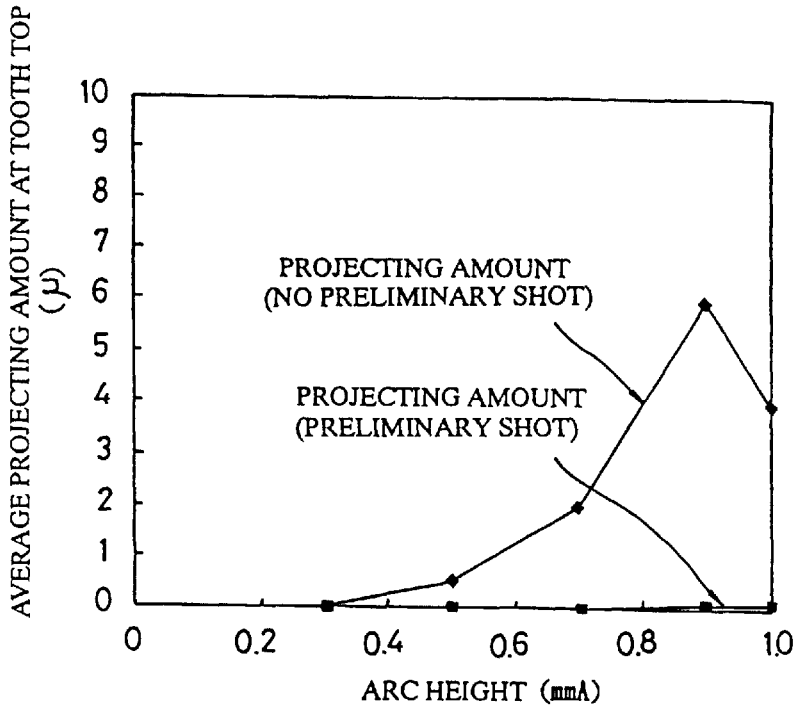
Figure 6:
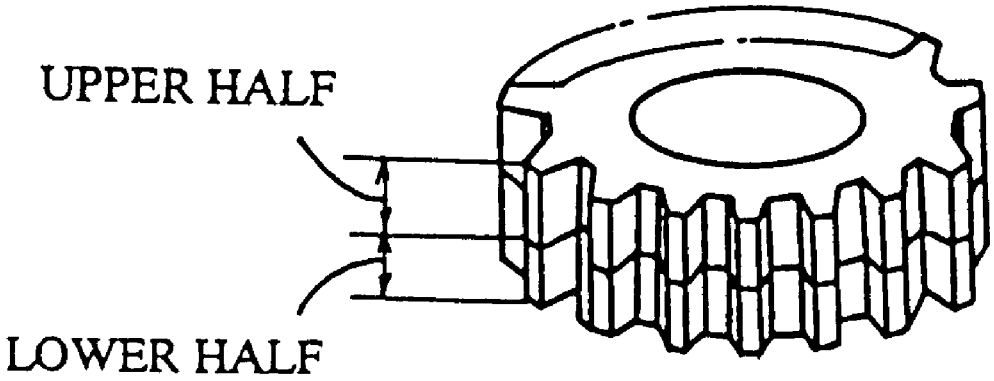

Reference is made to FIGS. 5 and 6 to describe a case where shot peening is applied to a gear by use of the system shown in FIG. 4. The gear used herein is a spur gear (module=3.0; pressure angle=20°; number of teeth =33; material=SNCM220H; it has undergone thermal treatment, carbonitriding, and quench-and-temper) having a diameter of 105.88 mm. The preliminary shot and the bottom land shot are both applied to the upper half of the gear shown in FIG. 6 by use of the air nozzles 7 and 7' whereas only the bottom land shot is applied to the lower half of the gear by use of the air nozzle 7'. Shot peening was carried out with arc height (this is an index indicating the power of a shot) being varied and performed 10 times with the same arc height. Table 1 demonstrates the steps of the tests conducted on the upper half and lower half of the gear in order.

TABLE 1

| UPPER HALF | LOWER HALF |
|---|---|
| (1) MEASUREMENT OF TOOTH PROFILE PRECISION | (1) MEASUREMENT OF TOOTH PROFILE PRECISION |
| (2) PRELIMINARY SHOT (TARGETING AT LEFT SURFACE) | |
| (3) MEASUREMENT OF TOOTH PROFILE PRECISION | |
| (4) PRELIMINARY SHOT (TARGETING AT RIGHT SURFACE) | |
| (5) MEASUREMENT OF TOOTH PROFILE PRECISION | |
| (6) BOTTOM LAND SHOT | (2) BOTTOM LAND SHOT |
| (7) MEASUREMENT OF TOOTH PROFILE PRECISION (MEASUREMENT OF PROJECTING AMOUNT) | (3) MEASUREMENT OF TOOTH PROFILE PRECISION (MEASUREMENT OF PROJECTING AMOUNT) |

In this test, the preliminary shot is performed with a stress of 2 kg/cm$^2$ and steel balls are used as shots. This preliminary shot is performed for the purpose of hardening the entire part of a tooth top evenly. There are no particular requirements for the preliminary shot, but practically the preferred preliminary shot is carried out with arc height which does not exceed the arc height of the bottom land shot in order not to impair the surface roughness of the tooth flanks. For comparison, FIGS. 5(*a*) and 5(*b*) show the results of the tests in the case of the presence of the preliminary shot and in the case of the absence of the preliminary shot. FIG.

5(*a*) is a graph showing the relationship between arc height, the maximum projecting amount at a tooth top and compressive residual stress, whereas FIG. 5(*b*) is a graph showing the relationship between arc height and the average projecting amount at a tooth top.

It is clear from the graph of FIG. 5 that where no preliminary shot was carried out, as arc height increases, compressive residual stress increases with increases in the projecting amount at a tooth top and in strength and with decreases in tooth flank precision. Also, it is to be understood that even if arc height is increased, the maximum projecting amount at a tooth top and the average projecting amount at a tooth top can be restricted by application of the preliminary shot.

The allowable projecting amount at a tooth top is approximately $5\mu$ which is obtained taking surface roughness into account. From this allowable amount, it is understood that no problems will practically arise if the preliminary shot is not performed when arc height is less than 0.6 mmA. However, a compressive stress of 100 kg/mm$^2$ or more (shown as minus value in FIG. 5) is required in the case of hard shot peening in which a high compressive residual stress is applied to a gear to impart high strength to it. Converting this compressive stress into arc height, 0.6 mmA or more is necessary. It means that when manufacturing strong gears with an arc height of 0.6 mmA or more, the projecting amount at a tooth top is $5\mu$ or more and therefore application of the preliminary shot according to this embodiment is indispensable. Theoretically, preliminary shot is useful when arc height exceeds 1.0 mmA, but in practice, it is usual to perform shot peening with an arch height of no more than 1.0 mmA with which a compressive residual stress is saturated.

The foregoing embodiment employs the air nozzle 7' for the bottom land shot in addition to the air nozzle 7 used for the preliminary shot. However, the air nozzle 7 for the preliminary shot may be used for the bottom land shot as well in one shot peening system by changing the installation angle of the air nozzle 7. While the gear is turned over in the preliminary shot step in order to uniformly harden the right and left sides of the gear in the foregoing embodiment, there may be disposed two air nozzles 7 one of which is for shooting at the left side face of the gear and the other of which is for shooting at the right side face of the same. It is also possible to shift the shooting direction of one air nozzle so as to make the preliminary shot from both the right and left sides.

While steel balls are used as the shots in the foregoing embodiment, glass beads, alumina balls or super hard balls may be used in place of steel balls. There are no limitations on the size of the shots used in the preliminary shot, but shots having a diameter of 1.2 mm or less are generally used.

While the shape adopted for the profile of each side of a tooth is an involute curve in the foregoing embodiment, the shape of the sides is not particularly limited to this, but may take various shapes such as cycloid curves and straight lines.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A shot peening method for gears for blasting an external surface of a gear with shots while rotating the gear to harden the external surface thereof, the gear comprising top lands, bottom lands, tooth flanks each curving from each bottom land to each top land, and chamfers of tooth top each positioned between each tooth flank and each top land, the method comprising the steps of:

(1) preliminarily shooting the shots such that the shots exclusively collide with a top of a tooth of the gear; and (2) shooting the shots at one of the bottom lands in a substantially perpendicular direction thereto after the preliminary shot step such that the shots collide with an entire surface of the gear.

2. The shot peening method according to claim 1, wherein in a plane that crosses an axis of the gear at right angles, the step of preliminarily shooting includes the step of aiming at a shooting target at a ridge point that is the intersection of a chamfer line of a tooth top and a tooth flank line, said lines being positioned in an upstream part of the tooth when viewing the tooth in a rotating direction of the gear, and wherein the step of preliminarily shooting includes the step of positioning the axis of a nozzle for the preliminary shot in an area between a bisector which bisects an interior angle of a corner having said ridge point as its intersection and a straight line which connects said ridge point and an apex of another tooth opposite to the ridge point.

3. The shot peening method according to claim 1, wherein in a plane that crosses the axis of the gear at right angles, the step of preliminarily shooting includes the step of aiming at a shooting target at a ridge point that is the intersection of the chamfer line of tooth top and the tooth flank line, said lines being positioned in the downstream part of the tooth when viewing the tooth in the rotating direction of the gear, and wherein the step of preliminarily shooting includes the step of positioning the axis of a nozzle for the preliminary shot in an area between a prolongation of a top land line and a prolongation of the chamfer line of a tooth top of the downstream part.

* * * * *